US006224750B1

(12) United States Patent
Pittman et al.

(10) Patent No.: US 6,224,750 B1
(45) Date of Patent: May 1, 2001

(54) PRODUCING LOW SULFUR HYDROCARBONS WITH BIOLOGICALLY REGENERATED CAUSTIC

(75) Inventors: Rusty Mark Pittman, Chicago; Blaise J. Arena, Des Plaines, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/421,146

(22) Filed: Oct. 19, 1999

Related U.S. Application Data

(60) Provisional application No. 60/106,578, filed on Nov. 2, 1998.

(51) Int. Cl.[7] ..... C10G 19/00

(52) U.S. Cl. ..... 208/226; 208/228; 208/230; 208/235; 208/236; 208/237; 208/227

(58) Field of Search ..... 208/228, 230, 208/235, 236, 277, 226

(56) References Cited

U.S. PATENT DOCUMENTS 4,033,410 * 7/1977 Kauffman ..... 423/228
4,055,400 * 10/1977 Stambaugh et al. ..... 44/1 R
4,391,608 * 7/1983 Dondelewski ..... 44/1 R
4,708,620 * 11/1987 Bricker ..... 208/235
4,722,432 * 2/1988 Weston et al. ..... 423/178
5,017,279 * 5/1991 Oswald et al. ..... 208/67
5,582,714 * 12/1996 Forte ..... 208/233

* cited by examiner

*Primary Examiner*—Helane Myers
(74) *Attorney, Agent, or Firm*—John G. Tolomei; John F. Spears, Jr.

(57) ABSTRACT

A process is disclosed for producing very low sulfur content hydrocarbon streams by contacting a hydrocarbon feed-stream with an aqueous alkaline treatment stream which has been regenerated by the biological conversion of sulfur compounds to elemental sulfur. The process is characterized by the step of contacting the partially regenerated aqueous treatment stream with a hydrocarbon wash stream to remove low levels of residual elemental sulfur suspended in the partially regenerated treatment stream.

12 Claims, 1 Drawing Sheet

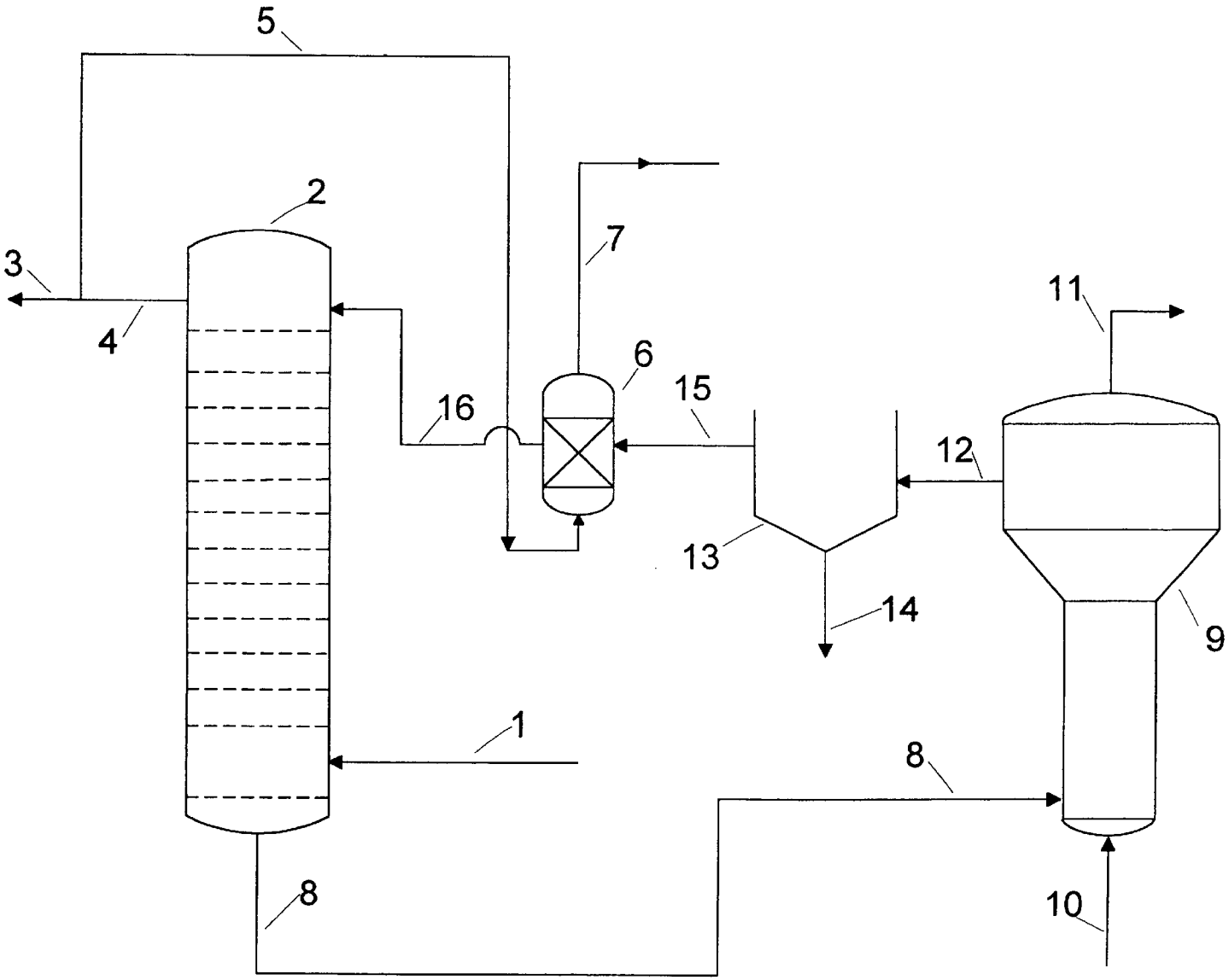
1
2
3
4
5
6
7
8
8
9
10
11
12
13
14
15
16

PRODUCING LOW SULFUR HYDROCARBONS WITH BIOLOGICALLY REGENERATED CAUSTIC

CROSS-REFERENCE TO RELATED APPLICATION

This application claims the benefit of U.S. Provisional Application No. 60/106,578, filed on Nov. 2, 1998.

FIELD OF THE INVENTION

The invention relates to a biological process for removing sulfur compounds from a hydrocarbon stream. The invention more directly relates to a process for removing sulfur compounds from a hydrocarbon stream through the use of an aqueous caustic stream which is regenerated in a biological reaction zone. The invention specifically relates to the production of very low sulfur hydrocarbon products through the use of a purified stream of caustic which has been regenerated in an aerobic bioreactor.

BACKGROUND OF THE INVENTION

Unprocessed hydrocarbons derived from crude oil and natural gas tend to contain a number of sulfur compounds. These compounds or the sulfur they contain must be removed before the hydrocarbons are suitable for use. There are two prime reasons for this. First, the release of sulfur or sulfur compounds into the atmosphere is a significant environmental concern which is coming under increased regulatory constraints. Second, sulfur must be at a very low concentration in various hydrocarbon streams in order to meet the quality standards for these hydrocarbon products. It is therefore necessary for petroleum refineries, gas processing plants and other industrial facilities to remove sulfur compounds of various types from raw material fractions and from partially processed hydrocarbon fractions such as hydrogen-rich gas streams, natural gas, diesel fuel, naphtha and LPG. This need to remove the sulfur compounds is independent of whether the hydrocarbons are intended for use as a motor fuel or as a petrochemical feedstock.

Many different techniques such as hydrotreating are widely used for removing sulfur compounds from hydrocarbon streams. Most of these techniques include a step in which a liquid phase or gas phase hydrocarbon stream is contacted with an aqueous stream containing a dissolved alkaline material. The aqueous stream, commonly referred to as "caustic" is employed to remove acidic sulfur compounds from both vapor phase or liquid phase process streams. The result is the formation of a sulfur-rich alkaline aqueous stream; that is, one containing an increased concentration of a sulfur compound such as hydrogen sulfide. The rich aqueous stream must be regenerated so that it can be reused. The subject invention provides a process for regenerating hydrogen sulfide rich alkaline aqueous streams in a manner which converts the hydrogen sulfide to recovered elemental sulfur. To accomplish this, the subject invention passes the hydrogen sulfide rich aqueous stream into a biological reaction zone, a term which is used herein to describe both single reactor and multiple reactor apparatus. It may contain zones for performing both aerobic and anaerobic reactions. This biological reaction zone employs naturally occurring microorganisms that catalyze the conversion of sulfur compounds to elemental sulfur which is physically removed. The subject invention then purifies the treated aqueous stream to remove additional elemental sulfur.

RELATED ART

An overview of the application of biological treatment to sulfur-containing waste streams such as sulfidic caustic generated in a petroleum refinery is found in paper No. AM-98-27 presented at the 1998 NPRA Annual Meeting held Mar. 15–17, 1998 in San Francisco, Calif. This reference describes the use of a bioreaction zone which may comprise both anaerobic and aerobic sections or a single aerobic section for the treatment of waste streams containing sulfates or hydrogen sulfide. The reference describes in general terms the application of this biotechnology to the treatment of waste streams generated in several different treatment processes. The reference also presents a schematic diagram of a bioreactor suitable for use in the process.

A simplified process flow diagram and a brief description of the application of biotreating to gas streams containing hydrogen sulfide is provided at page 89 of the August 1998 edition of *Hydrocarbon Processing*. The description refers to the recycling of "sulfur-free" aqueous solution thus showing a lack of recognition of the subject invention. The reference treats a gas stream which would not be expected to pick up elemental sulfur from the aqueous solution.

Processes for the conversion of sulfur-containing compounds present in aqueous streams including sulfidic caustic used in scrubbing $H_2S$ from a process stream are described in U.S. Pat. Nos. 5,366,633; 5,518,619; and, 5,637,220 issued to C. J. N. Buisman. These references describe the conversion of the sulfur compounds to elemental sulfur. U.S. Pat. No. 5,366,633 indicates that a separator 7 can be used to treat the effluent of the reactor 4 to separate elemental sulfur from the process liquid, The text indicates the elemental sulfur can be removed by physical separation such as settling, centrifuging, flocculation or filtration. However, there is believed to be no disclosure in these references of methods to produce high purity liquid-phase hydrocarbon products, to remove trace amounts of suspended elemental sulfur still present in the treated aqueous stream after the initial physical separation or of techniques to adopt this technology to treating liquid-phase hydrocarbon feed streams instead of water.

BRIEF SUMMARY OF THE INVENTION

It has now been found that aqueous caustic solutions which have been regenerated by means of the previously cited biotechnology contain a small but significant amount of elemental sulfur which is carried over due to incomplete separation of particulate sulfur from the bioreactor effluent and possibly formed after the separation. Further, it has been determined that at least a portion of this sulfur readily dissolves in a hydrocarbon stream which is subsequently being treated by the regenerated caustic. The result is the hydrocarbon stream picks up sufficient dissolved elemental sulfur that the level of sulfur contamination can cause the treated hydrocarbon to fail standard product quality test methods. In summary it has been found that the freshly regenerated aqueous solution, which is supposed to readily remove sulfur compounds from the feed hydrocarbon, unexpectedly gives up elemental sulfur to the feed stream The subject invention centers around the elimination of this carryover elemental sulfur in the treated aqueous stream. One broad embodiment of the subject invention may be characterized as a process which comprises passing a feedstream comprising hydrocarbons and sulfur-containing compounds through an extraction zone in which at least a major portion of the sulfur-containing compounds are removed from the feedstream by contact with an aqueous treatment stream, and thereby producing a hydrocarbon product stream containing less than about 3 wt. ppm combined hydrogen sulfide and elemental sulfur and a rich aqueous treatment stream; passing the rich aqueous treatment stream into a biological reaction zone in which elemental sulfur is formed, and forming a biological reaction zone effluent stream comprising particulate elemental sulfur; separating particulate elemental sulfur from the biological reaction zone effluent stream and thereby forming a partially regenerated treatment stream comprising an aqueous alkaline solution and entrained elemental sulfur; and contacting the partially regenerated treatment stream with a liquid-phase wash stream comprising a hydrocarbon in a contacting zone and removing entrained elemental sulfur from the partially regenerated treatment stream and thereby forming the aqueous treatment stream employed in the extraction zone.

BRIEF DESCRIPTION OF DRAWING

The drawing illustrates treatment of a hydrocarbon feed 1 and regeneration of used (rich) aqueous solution 8, with regenerated aqueous solution 15 being scrubbed with product hydrocarbons 5 to remove trace amounts of dissolved elemental sulfur.

DETAILED DESCRIPTION AND PREFERRED EMBODIMENTS

The subject process is directed to the production of very low sulfur hydrocarbon streams and begins with contacting a feedstream comprising the feed hydrocarbons and some sulfur-containing compounds with an aqueous treatment stream. The hydrocarbon feedstream may comprise a mixture of hydrocarbons having a significant boiling range such as a naphtha boiling range stream or may contain essentially only a single compound such as a butane or pentane. The hydrocarbons may be saturated or unsaturated and may be a mixture of saturated and unsaturated hydrocarbons or a mixture of paraffinic and cyclic compounds. The feedstream may be a vapor phase stream comprising nonhydrocarbons such as hydrogen or nitrogen but the subject process is more applicable to liquid phase streams which may contain dissolved elemental sulfur. In any event, the feedstream is contacted with an alkaline aqueous treatment stream in a manner which causes the transfer of one or more sulfur-containing compounds from the feedstream to the aqueous treating stream. This transfer is preferably promoted through multi-stage contact and may be performed in a conventional contacting system comprising a trayed tower or a series of mixing-settling contactors. Static inline mixing devices may also be employed to contact the aqueous treatment stream and the feedstream.

The preferred aqueous treatment stream comprises a bicarbonate solution adjusted to an alkaline pH of from 7.1 to about 12 as by the addition of sodium or potassium hydroxide. Especially preferred is a solution having a pH of from 7.5 to 10.5 such as a pH of 9.0. This relatively mild solution is preferred since it is compatible with the preferred bacteria used in the bioreaction zone. The solution can be formed by adding a relative low concentration of a basic anion; e.g., about 0.02 to 1.0 wt. % by means of an alkali metal or ammonium compound. Examples of compounds which can be employed include sodium carbonate, sodium bicarbonate, sodium phosphate, potassium phosphate, potassium carbonate, ammonium bicarbonate and ammonium phosphate. Two or more compounds can be used. This preference for a mild alkaline solution is in contrast to the use of high strength alkaline metal hydroxide, such as sodium hydroxide or potassium hydroxide solutions, as commonly employed in the petroleum refining industry. These solutions, often referred to simply as "caustic" may contain sodium hydroxide in concentrations of from about 1 to 40 wt. %. While the use of these stronger solutions is not desired, the subject process may be applied to any suitable alkaline material which is regenerable by biologic action can be employed in the subject process if desired. This basically requires a bacteria which can tolerate such a strongly basic solution. The tendency for strongly basic solutions to kill or damage the known suitable bacteria is the reason for the present preference for a bicarbonate solution. If desired, the alkaline solution may be concentrated or diluted between the extraction zone and the regeneration zone.

The contacting of the aqueous stream and the feedstream is performed at conventional extraction conditions using conventional equipment and results in the transfer of at least one sulfur compound to the aqueous treatment stream. The sulfur compounds may be inorganic sulfur compounds such as sulfate, sulfite, thiosulfate, or organic sulfur compounds such as carbon disulfide, dialkyl sulfides, mercaptans, sulfones, sulfoxides, sulfonic acids, etc. The process is normally very effective for treating feedstreams containing sulfate, sulfite, or thiosulfate compounds. Hydrogen sulfide is a particular common sulfur-containing compound which is removed from feedstreams in this manner.

The subject invention is very effective in producing a treated hydrocarbon stream having a total content of $H_2S$ and dissolved sulfur less than 2 ppm. This assumes that all the sulfur compounds present in the hydrocarbon stream are extractable by the aqueous treatment stream. The subject process therefore represents an improvement over systems which have difficulty in producing product streams having a total, defined as $H_2S$ plus dissolved elemental sulfur, content less than 5 ppm. It has now been discovered that this problem was due to the presence of elemental sulfur in the aqueous treatment stream, with at least a portion of this sulfur being transferred to the feed hydrocarbon stream due to the greater solubility of the elemental sulfur in the hydrocarbon stream as compared to the water stream. The amount of elemental sulfur transferred from the aqueous treatment stream to the hydrocarbon feedstream is dependent on several factors such as temperature, contact time, the concentration of dissolved sulfur in the treatment stream and the relative quantities of the treatment and hydrocarbon feedstreams. However, the level of elemental sulfur transferred to the hydrocarbon stream was sufficient that it would often fail the commonly referred to copper strip corrosion test and equivalent ASTM testing procedures. An ability to pass this test appears to be correlated with the combined concentration of hydrogen sulfide and elemental sulfur rather than the true total sulfur content of the hydrocarbon stream. Mercaptans appear to contribute little to failing the copper strip corrosion test and may be present at significant levels (e.g., 15–25 ppm) in the treated hydrocarbon product. It is an objective of the subject invention to provide an improved process by which the total $H_2S$ and dissolved sulfur content of the treated hydrocarbon stream is reduced to a level less than 5 ppm and preferably less than 2 wt. ppm sulfur.

This objective is achieved based upon a recognition that the sulfur content of the treated hydrocarbon product stream is not due directly to the carryover of particulate sulfur from the sulfur removal zone but is rather largely due to elemental sulfur transferring to the feedstream. That is, the feed hydrocarbon initially acts as a solvent for dissolved elemental sulfur in the aqueous solution. It is believed this problem has not been recognized and there has been no attempt to provide a solution to this problem. In the subject process, this problem is attacked by means of a second liquid-liquid contacting step in which the biotreated aqueous treatment solution is contacted with a hydrocarbon wash stream to remove additional amounts of dissolved sulfur beyond that removed by physical separation. This occurs after the physical separation of the particulate sulfur from the aqueous treatment and the contacting of hydrocarbon feedstream with the aqueous treatment liquid.

The subject invention also addresses the apparently unappreciated problem of the continued formation of elemental sulfur after the aqueous treating solution is withdrawn from the bioreactor and has passed through the physical separation device(s) used to remove particulate sulfur from the aqueous solution. This is due to the fact that the aqueous solution will still contain some low concentrations of suspended bacteria, sulfides and oxygen. Under suitable conditions this bacteria will continue to function as in the reaction zone and produce elemental sulfur. The level of elemental sulfur in the treating solution is therefore potentially higher when it is later used as the treating solution than when it leaves the bioreactor/separator regeneration zone.

This washing procedure may be performed at conventional conditions using conventional liquid-liquid extraction equipment similar to that employed in the extraction of the sulfur compounds from the feedstream. A temperature from about 10 to 80° C. and the use of a trayed countercurrent contacting column are preferred. The amount of hydrocarbon wash liquid employed need not be large as the amount of sulfur in the treatment liquid is quite low. It is expected that in all instances a hydrocarbon wash stream having a flow rate equal to between about 1 and 5 volume percent of the aqueous treatment liquid will be sufficient if there is good contacting, at least several theoretical stages, between these liquids. The hydrocarbon wash liquid can be from an external source or a recycled portion of the final product of this process. The primary requirement of a suitable wash liquid is a very low dissolved sulfur content, preferably less than 1 ppm, and a character which allows for facile contacting and separation. Separation is aided by significant differences in solubility and density.

LPG (liquified petroleum gas) is a mixture of light paraffinic hydrocarbons including propane and butane which are gaseous at standard conditions. LPG is a preferred washing liquid due to its high density difference from water. This is especially so when the feedstream to the process is LPG and a small portion of the final product can be recycled as wash liquid. LPG is also preferred since the sulfur can easily be separated from the LPG by flashing, which allows easy recovery of the sulfur from the resulting vapors. A wide variety of other hydrocarbons such as naphtha or vegetable oil can also be used was the wash liquid.

Referring now to the Drawing, a hydrocarbon feedsteam enters the process through line 1. It is passed upward through a trayed contacting column 2 countercurrent to a descending liquid phase alkaline stream referred to herein as caustic. This removes such sulfur containing impurities as hydrogen sulfide from the incoming hydrocarbons and produces a treated hydrocarbon stream removed via line 4. One or more mixer-settlers or static inline mixing devices could alternatively be employed. A first portion of the treated hydrocarbons is recycled via line 5 and the remaining portion is withdrawn from the process as a net hydrocarbon product stream carried by line 3. The transfer of the sulfur containing compound(s) from the feedstream to the aqueous treating solution produces a "rich" aqueous stream removed from the bottom of the contacting column via line 8. The term rich is not used herein to denote a high percentage concentration of a compound. Rather it refers to a used solvent stream which has picked up some amount of the extractable compound in a contacting zone.

The rich aqueous stream is passed into the bioreaction zone 9. Also passed into the bioreaction zone is an oxygen containing stream such as air from line 10. This is necessary to support the biological conversion of sulfide ($HS^-$) to elemental sulfur and the bioregeneration of the aqueous treating solution which produces the hydroxide ion. The residual gases are removed via line 11 and a stream of regenerated aqueous treating solution is removed from the bioreaction zone 9 via line 12. The regenerated aqueous solution will contain some particulate elemental sulfur carried over from the reactor. The regenerated aqueous solution is therefore passed into a clarifier 13. The clarifier exemplifies the different types of alternative physical separation units which may be employed such as a settling tank, filter, tilted plate separator, etc. The majority of the elemental sulfur is removed by this physical separation unit or a series of physical separation units to produce a sulfur product stream carried by line 14. This produces a low elemental sulfur content stream of regenerated aqueous treating solution which is transferred via line 15 to a contacting zone 6. The liquid-liquid contacting zone 6 comprises a means to contact the aqueous solution with a smaller flow rate stream of product hydrocarbons which have been recycled through line 5. This contacting, which may be several cocurrent stages but is preferably a countercurrent passage through a bed of contact material, causes the elemental sulfur remaining in the aqueous solution to become dissolved in the liquid-phase hydrocarbon solvent. The two streams are then separated, with the aqueous treating solution being passed into an upper portion of the contacting column 2 via line 16. The used hydrocarbon washing liquid is removed via line 7 and processed for the separation of the sulfur from the hydrocarbon as by a flashing operation. The solvent stream of line 5 could be derived from other sources and may differ in composition from the feed stream. LPG is a preferred solvent because of the relatively large density difference between LPG and the aqueous caustic and the greater ease of separation of the sulfur by flashing. The vaporous sulfur-free LPG can then be condensed and recycled.

In the subject process the rich or "spent" aqueous treatment stream produced by contact of the treatment stream with the feed hydrocarbon stream in the extraction zone is passed through a biotreatment zone for the regeneration of the aqueous treating solution and the conversion of the sulfur compounds into elemental sulfur. The biotreatment zone of the subject process may comprise a single reaction zone or two or more separate reaction zones. Multiple reaction zones may be employed in the process to perform different reactions under different conditions and to thereby produce different sulfurous products. For instance, an aqueous treating solution containing sulfites may be first subjected to an anaerobic biotreatment step in which the aqueous liquid is contacted with a suitable bacteria in the presence of added hydrogen to reduce the sulfites to hydrogen sulfide. The effluent of this reaction zone can then be passed into an aerobic bacterial treatment step in which the hydrogen sulfide is reacted with oxygen to form elemental sulfur. Also formed in this step are the hydroxide ion which replenishes the alkaline liquid or reacts with $CO_2$ to form bicarbonate $HCO_3^{2-}$ used in the feedstream treating procedure. These two reaction steps may be performed at conventional conditions of temperature, pressure, flow rate and chemical composition.

Suitable bacteria for use in an anaerobic reaction section for reducing sulfur compounds to sulfides include species of the genera Desulfovibrio, Desulfotomaculum, Desulfomonas, Desulfobulbus, Desulfobacter, Desulfococcus, Desulfonema, Desulfosarcina, Desulfobacterium and Desulforomas. Suitable oxidizing bacteria for use in the aerobic reaction section include the oxidizing bacteria of the genera Thiobacillus and Thiomicrospira.

The aerobic reactor is operated at an oxygen content in the broad range of about 0.1 to 9.0 milligram $O_2$/l and preferably between about 0.4 and 2.0 moles $O_2$/mole total sulfur.

The rate at which the sulfides are charged to this reactor is an important process variable. An aerobic reactor should be operated at a sulfide load greater than 0.5 g sulfide per liter per day (0.5 g sulfide/ld). Sulfur loadings in the range of 0.5 g S/l • d to 10 gS/l • d are generally acceptable. Lower sulfide loads tend to promote the formation of sulfates which are more difficult to remove than elemental sulfur. As used herein the term sulfide is intended to include all mono and poly sulfur inorganic and organic species of divalent sulfur including the sulfides and hydrosulfides, hydrogen sulfide, and polysulfides. Low loadings tend to promote growth of filamentous oxidizing bacteria. Excessive sulfide loading can be avoided as by dilution through recycling of treated material from the reactor outlet Variation in the recycle rate can be used to accommodate a wide range of sulfide content in the untreated aqueous feedstream.

The aerobic bioreaction zone may comprise multiple reactors. The construction of the individual reactors may differ but is preferably the same. Each reactor must comprise a means of bringing the aqueous feedstream into contact with the bacteria. This may be done by immobilizing the bacteria on supports through which the liquid flows or by retaining the bacteria on numerous small particles which are circulated with the aqueous stream. Reactors of conventional design may be employed in the subject process, and further details on reactor design are available in the references cited herein. Often two reactors are used in series flow. Preferably the first aerobic reactor is relatively small and therefore has a relatively high flow rate. For instance the retention time in the first reactor can be from about 20–30 minutes to several hours. The second aerobic reactor can have a retention time of 24 hours or more. If desired a separation zone may be employed between the reaction zones to remove particulate sulfur and free flowing biological material.

The bioreaction zones of the subject process will operate at a basic pH as they are regenerating an alkaline material. A general preferred pH range for the reactions zones is from about 10.5 to 7.5. The average temperature of the reaction zones is fairly moderate, with a general temperature range being from about 10 to 90° C. This is determined to some extent by the preferred living environment for the bacteria.

The aerobic biotreatment of the subject process produces elemental sulfur which tends to concentrate as small particles suspended in the aqueous treatment stream. At least a majority of these particles are removed from the treatment stream in the physical separation step and can form the source for a sulfur product stream removed from the overall treatment process. In some modes of operation a portion of the sulfur particles can be recycled to the biotreatment zone as a means to recycle bacteria. However, it is not desired to have appreciable content of the solid sulfur particles in the regenerated aqueous alkaline solution removed from the bioreaction zone. To this end, the solution emanating from the aerobic biotreatment step is passed into a separation zone in which the sulfur particles are removed. The method employed for this separation step is not controlling and any of the known solid-liquid separation techniques which are suitable for this separation can be employed. The use of a tilted plate separator is preferred. Another suitable separation method is filtration. In this method the treated alkaline stream is passed through either a fixed or moving filtration media such as a screen, cloth or powder-coated porous filtration support.

The visually clear liquid produced in this manner is then passed into the next step in the subject process. The next step is the second contacting procedure in which sulfur is removed from the liquid by the hydrocarbon wash stream. The subject process therefore comprises the sequential and separate steps of physical sulfur removal and sulfur extraction performed on the same alkaline treating stream.

The invention may accordingly be characterized as a process comprising passing a feedstream comprising LPG and a sulfur-containing compound through a liquid-phase extraction zone in which at least a major portion of the sulfur-containing compound is removed from the feedstream by contact with an alkaline aqueous treatment stream, and thereby producing an LPG product stream containing less than about 2 wt ppm combined hydrogen sulfide and elemental sulfur and also producing a rich aqueous treatment stream; passing the rich aqueous treatment stream into a biological reaction zone in which elemental sulfur is formed from a sulfur compound present in the rich aqueous stream, and forming a biological reaction zone effluent stream comprising particulate elemental sulfur; removing particulate elemental sulfur from the rich aqueous treatment stream and forming a regenerated treatment stream; and, washing elemental sulfur from the regenerated treatment stream by contact with a hydrocarbon wash stream and reducing the total $H_2S$ and elemental sulfur content of the regenerated treatment stream to below about 2 wt ppm., and then passing the thus regenerated alkaline aqueous treatment stream into the extraction zone.

The table below summarizes tests performed using washing streams of various compositions. In each batch test 1000 g of each solvent was added to 2000 g of regenerated alkaline treating solution. The solutions were mixed at room temperature for 10 minutes and then decanted.

| Solvent | Sulfur in Fresh Solvent | Sulfur in Regenerated Solution | % Sulfur Removal |
|---|---|---|---|
| Vegetable oil | 6 ppm | 12 ppm | 83 |
| Toluene | 0 | 12 | 92 |
| Reformate | 0 | 12 | 92 |
| Naphtha | 0 | 57 | 91 |

What is claimed is:

1. A process comprising:

a.) passing a feedstream comprising hydrocarbons and sulfur-containing compounds through an extraction zone in which at least a major portion of the sulfur-containing compounds are removed from the feedstream by contact with an aqueous treatment stream, and thereby producing a hydrocarbon product stream containing less than about 3 wt ppm combined hydrogen sulfide and elemental sulfur and a rich aqueous treatment stream;

b.) passing the rich aqueous treatment stream into a biological reaction zone in which elemental sulfur is formed, and forming a biological reaction zone effluent stream comprising particulate elemental sulfur;

c.) separating particulate elemental sulfur from the biological reaction zone effluent stream and thereby forming a partially regenerated treatment stream comprising an aqueous alkaline solution and elemental sulfur; and d.) contacting the partially regenerated treatment stream with a liquid-phase wash stream comprising a hydrocarbon in a contacting zone and removing elemental sulfur from the partially regenerated treatment stream and thereby forming the aqueous treatment stream employed in the extraction zone.

2. The process of claim 1 in which the concentration of elemental sulfur in the partially regenerated treatment stream is reduced from greater than 4 ppm to less than 2 ppm during passage through the contacting zone.

3. The process of claim 1 in which a portion of the product stream is passed into the contacting zone as the wash stream.

4. The process of claim 3 in which the feedstream comprises LPG.

5. A process comprising:

a.) passing a liquid phase feedstream comprising hydrocarbons having three or more carbon atoms per molecule and a sulfur-containing compound through an extraction zone in which at least a major portion of the sulfur-containing compound is removed from the feedstream by contact with an alkaline aqueous treatment stream, and thereby producing a hydrocarbon product stream containing less than about 3 wt ppm combined hydrogen sulfide and elemental sulfur and also producing a rich aqueous treatment stream;

b.) passing the rich aqueous treatment stream into a biological reaction zone in which elemental sulfur is formed, and forming a biological reaction zone effluent stream comprising particulate elemental sulfur;

c.) physically removing particulate elemental sulfur from the biological reaction zone effluent stream and thereby forming a regenerated treatment stream; and, d.) washing dissolved sulfur from the regenerated treatment stream by contact with a hydrocarbon wash stream and reducing the dissolved sulfur content of the regenerated treatment stream to below about 2 wt ppm., and then passing the resultant regenerated treatment stream into the extraction zone.

6. The process of claim 5 wherein the hydrocarbon product stream has a sulfur content less than 2 wt. ppm.

7. The process of claim 5 wherein the feedstream is a naphtha boiling range stream.

8. A process comprising:

a.) passing a feedstream comprising LPG and a sulfur-containing compound through a liquid-phase extraction zone in which at least a major portion of the sulfur-containing compound is removed from the feedstream by contact with an alkaline aqueous treatment stream, and thereby producing an LPG product stream containing less than about 2 wt ppm combined hydrogen sulfide and elemental sulfur and also producing a rich aqueous treatment stream;

b.) passing the rich aqueous treatment stream into a biological reaction zone in which elemental sulfur is formed from a sulfur compound present in the rich aqueous stream, and forming a biological reaction zone effluent stream comprising particulate elemental sulfur;

c.) removing particulate elemental sulfur from the rich aqueous treatment stream and forming a regenerated treatment stream; and, d.) washing elemental sulfur from the regenerated treatment stream by contact with a hydrocarbon wash stream and reducing the total $H_2S$ and elemental sulfur content of the regenerated treatment stream to below about 2 wt ppm., and then passing the thus regenerated alkaline aqueous treatment stream into the extraction zone.

9. The process of claim 8 wherein the LPG product stream has an $H_2S$ and elemental sulfur content less than 1 wt. ppm.

10. The process of claim 8 wherein the hydrocarbon wash stream is a portion of the LPG product stream.

11. The process of claim 8 wherein the alkaline aqueous solution comprises a bicarbonate solution.

12. The process of claim 8 wherein the hydrocarbon wash stream comprises LPG and sulfur is subsequently removed from the hydrocarbon wash stream by flashing the LPG to a vapor.

* * * * *